United States Patent [19]

Romanenko

[11] 4,330,615

[45] May 18, 1982

[54] BLUE BACKGROUND SLIDES FROM A BLACK AND WHITE FILM PROCESS

[76] Inventor: Alexandra Romanenko, 2180 Jack's Creek Pike, Lexington, Ky. 40515

[21] Appl. No.: 247,606

[22] Filed: Mar. 25, 1981

[51] Int. Cl.[3] ..... G03C 7/00

[52] U.S. Cl. ..... 430/370

[58] Field of Search ..... 430/368, 370, 367

[56] References Cited

U.S. PATENT DOCUMENTS

| | | | |
|---|---|---|---|
| 1,009,100 | 11/1911 | Rehlander | 430/368 |
| 2,312,874 | 3/1943 | Bunting | 430/368 |
| 2,659,674 | 11/1953 | Hyndman | 430/370 |
| 3,161,510 | 12/1964 | Gosmann | 430/368 |

OTHER PUBLICATIONS

Brooks, "How to Select and Use Photographic Materials and Processes", pp. 92–94, H. P. Books, Tucson, Az, 1979.

*Primary Examiner*—L. Travis Brown

[57] ABSTRACT

A rapid simple process of making blue background imaged transparent negatives with "white" or transparent letters from high contrast black and white film. The film is exposed, developed and washed according to manufacturer's directions. The same film is then immersed into three different toner solutions, fixed, washed and dried. The product of the process, an imaged transparent negative with blue background and "white" or transparent letters, can be mounted as a slide.

1 Claim, No Drawings

BLUE BACKGROUND SLIDES FROM A BLACK AND WHITE FILM PROCESS

SUMMARY

This process for blue background imaged transparent negatives is simple and rapid. It differs from existing processes because it does not require color film, filters, film reversal, re-exposure over a light source, second development, temperature control, separate negatives, special cameras or accessories. The original exposed film, toned in the Blue Background Process (BBP) is mounted into slides. High contrast, black and white film is used to copy the subject. The film is developed, stopped, fixed and washed in the regular manner. The film is then immersed in three different toner solutions, fixed, washed and dried. The process is rapid, approximately 1.5 hrs and results in an image transparent negative with "white" or transparent letters on a brilliant blue background, which is then mounted as a slide. The colors are permanent and do not fade with repeated projections.

DETAIL

Blue background imaged transparent negatives with "white" or transparent letters are frequently chosen for presentation of data over black and "white" or transparent slides because they create a better psychological atmosphere and less eye strain for the viewer.

A higher contrast black and white film such as Kodalith Ortho 6556 type 3 or Plus X is used to photocopy line drawings, printed text material etc., i.e. solid black letters or lines on a white background. The film is exposed according to manufacturer's directions. It is then developed, stopped, fixed and washed in the regular manner. Any one of the 35 mm developing tanks may be used. However, a metal developing reel should be used to wind the film instead of a plastic apron in order to assure even developing and toning of film. A very high contrast negative image is produced on the film, i.e. black background with "white" or transparent letters (hence white). At this point, the film may be dried and stored for future blue background processing. Image quality of the final slide will not be affected.

At a later date, rewind the stored film on a metal developing reel, wash it for approximately 10 minutes and then continue with the Blue Background Process (BBP). While the film is washing, prepare:

Toner Blue: dissolve in 500 ml of $H_2O$, 2.0 g oxalic acid, 2.0 g potassium ferricyanide, 2.1 g ferric ammonium citrate.

Toner Brown: dissolve in 400 ml of $H_2O$, 1.5 g iodine crystals, 25.0 g potassium iodide, 5.0 g glacial acetic acid, Filter solution to remove undissolved crystals and store in a dark brown bottle.

Toner Clear: dissolve in 500 ml of $H_2O$, 2.0 g sodium metabisulfite.

Fixer: according to manufacturer's directions

The procedure may be done in daylight, at room temperature and without special safety precautions. Agitation of Toners or rinsing of film between immersion steps is not necessary.

PROCEDURE

1. Immerse metal developing reel with washed film (hence film) into Toner Blue for 15 minutes—until white letters look blue.
2. Immerse film into Toner Brown for 5 minutes—until film is an even light brown in color.
3. Immerse film into Toner Clear for 5 minutes.
4. Immerse film into Fixer for 25 minutes. One side of the film will have a white opaque color. Keep film in fixer until all white disappears.
5. Wash film for 15 minutes, photo-flo and dry.
6. Mount blue and white imaged transparent negatives into slide holders.

The resulting image now has a brilliant blue background with white letters. The photocopying of black letters on a white background with high contrast black and white film and processing it by the above method, results in a slide which now has white letters on a blue background.

Some processes such as the double exposure method require that first a black and white negative be made i.e. developed, stopped, fixed, washed and dried. Then color film has to be exposed through a blue filter, rewound in the camera and re-exposed to the black and white negative which has been placed over a light source. The black and white negative is then discarded. The color film has to be developed with special chemicals and critical temperature controls. In Blue Background Process, the original film used is the resulting slide—a substantial monetary saving for the professional—for nothing is discarded. Because only black and white film is used, special equipment and temperature controls essential for color film development are not required. Other special equipment required by diazo reversal or other methods as: diazo film, filters, color film, cameras with perfect registration for film reversal, ultraviolet lights, light source box is not needed in this process. Instead of costly chemicals, BBP uses generic laboratory chemicals, easily available and useable in ordinary room conditions.

Because of minimum equipment, standard temperature requirements, only one exposure and development step and simple toning procedure, this process is rapid, taking 1.5 hours to complete. Also, because of its' simplicity, the user of this process does not need special training or skills.

Finally, the slide from Blue Background Process has permanent colors which do not fade with repeated projections.

I claim:

1. A blue background process for converting black and white imaged transparent negatives to blue and white imaged transparent negatives comprising (a) immersing said black and white imaged transparent negative in a blue toner comprising an aqueous solution of oxalic acid, potassium ferricyanide and ferric ammonium citrate;

(b) thereafter immersing in a brown toner comprising an aqueous solution of iodine, potassium iodide and glacial acetic acid;

(c) thereafter immersing in a clear toner comprising an aqueous solution of sodium metabisulfite; and (d) fixing.

* * * * *